US005540602A

United States Patent [19]

Bell

[11] Patent Number: 5,540,602

[45] Date of Patent: Jul. 30, 1996

[54] TERMINAL JUNCTION BLOCK HAVING COMMONED BUS MEMBERS

[75] Inventor: Richard D. Bell, York, Pa.

[73] Assignee: The Whitaker Company, Wilmington, Del.

[21] Appl. No.: 497,009

[22] Filed: Jun. 30, 1995

[51] Int. Cl.[6] ..... H01R 9/22

[52] U.S. Cl. ..... 439/721

[58] Field of Search ..... 439/721, 723, 439/724, 507

[56] References Cited

U.S. PATENT DOCUMENTS

| | | | |
|---|---|---|---|
| 3,397,384 | 8/1968 | Lawrence | 439/721 |
| 4,491,381 | 1/1985 | Hamsher, Jr. et al. | 339/107 |
| 4,552,423 | 11/1985 | Swengel, Jr. | 339/19 |
| 4,582,376 | 4/1986 | Olsson | 339/19 |
| 4,602,833 | 7/1986 | Grabbe et al. | 339/19 |
| 4,671,599 | 6/1987 | Olsson | 439/188 |
| 4,726,787 | 2/1988 | Stine | 439/510 |
| 4,786,258 | 11/1988 | Shaffer et al. | 439/188 |
| 4,820,194 | 4/1989 | Stine | 439/510 |
| 4,842,534 | 6/1989 | Mobley et al. | 439/723 |
| 4,935,284 | 6/1990 | Puerner | 428/137 |
| 4,975,078 | 12/1990 | Stroede et al. | 439/405 |
| 5,007,888 | 4/1991 | Goutiere | 439/507 |
| 5,123,854 | 6/1992 | Petersen et al. | 439/188 |
| 5,211,578 | 5/1993 | Henschen et al. | 439/494 |
| 5,334,025 | 8/1994 | Fohl | 439/188 |
| 5,403,204 | 4/1995 | Chishima et al. | 439/723 |

OTHER PUBLICATIONS

*Matrix Science Brochure*, "MATRIX Terminal Junction System", 14 pages; 1988; Matrix Science Corporation, Torrance, CA 90503.

*Primary Examiner*—P. Austin Bradley
*Assistant Examiner*—Yong Kim
*Attorney, Agent, or Firm*—Anton P. Ness

[57] ABSTRACT

A terminal junction block 10 having elongate bus members 20 therein each for commoning the terminals 24 of a respective row. Commoning clips 60 within slots 62 of main housing member 14 are positioned transverse of the bus members 20 and common the bus members 20 to each other, thus commoning all terminals 24 of the respective rows.

15 Claims, 5 Drawing Sheets

TERMINAL JUNCTION BLOCK HAVING COMMONED BUS MEMBERS

FIELD OF THE INVENTION

This relates to the field of electrical connectors and more particularly to connectors for commoning circuits of conductor wires.

BACKGROUND OF THE INVENTION

Terminal junction blocks are known in which a housing block contains rows of apertures extending into a housing mating face adapted to receive insertably completely thereinto pin contacts terminated onto ends of discrete conductor wires. Upper portions of the apertures contain retention clips to lock the pin contacts in the apertures upon insertion. Aligned with each row of apertures and along the bottom of the housing body are channel-shaped bus members having spring arms electrically engageable with the pin contacts upon full insertion, thus commoning all pin contacts of each row. In a feedback version, all contacts are insertable into apertures of the same mating face of the block, and a bottom cover insulates the bus members along the housing bottom. Preferably, a sealing grommet across the mating face provides sealing about the insulated conductor wire portions adjacent the pin contacts. One contact-terminated wire provides power input to the terminal junction block, that the bus member distributes to all other contacts inserted into the same row as power output. In a feedthrough version, the bus members have channels twice as deep extending beneath the main housing, and an additional housing block with grommet is assembled beneath the main housing and includes channels to contain portions of the bus members depending from the main housing; a second mating face provides for insertion of another like array of contacts into the additional housing and through holes in the channel bottoms of the bus members to be electrically engageable by additional spring arms of one of the bus members, thus being commoned to the contacts extending into the main housing and engaged by the bus members.

It is desired to provide commoning between the rows of contacts while maintaining the compact nature of the arrangement and the design of the bus members.

SUMMARY OF THE INVENTION

One or more conductive clips are secured within slots of the main housing of the housing block extending between the bus members and offset from adjacent ones of the apertures of each row. The clips are essentially thin and planar and preferably inserted into the bottom of the main housing so that they are insulated from exposure along the mating face, with the bottom cover insulating them from exposure along the bottom face of the main housing. A body section of each clip is positioned transverse of the bus members and in aligned slots extending into top edges of the side walls of the channel-shaped bus members, and short tabs protrude from each end of the body section to be disposed in respective slots. A center leg depends from the center of the clip body section to be disposed between the facing side walls of the bus members, and respective contact sections depend from the clip body section and are shaped and dimensioned to be received into the channels of the bus members while clamping a side wall of the respective bus member against the center leg. Preferably a commoning clip is positioned between each pair of adjacent contact sites thus providing a plurality of commoning sites along the elongate bus members to assure equal distribution of power from the input site to all contact sites along the bus members.

It is an objective of the present invention to provide commoning of the bus members of a terminal junction block.

It is also an objective to provide such commoning while requiring minimal modification to existing parts of a conventional terminal junction block.

It is further an objective to provide commoning members that retain the existing spacing between terminal sites.

DETAILED DESCRIPTION OF THE PRESENT INVENTION

Figure 1:
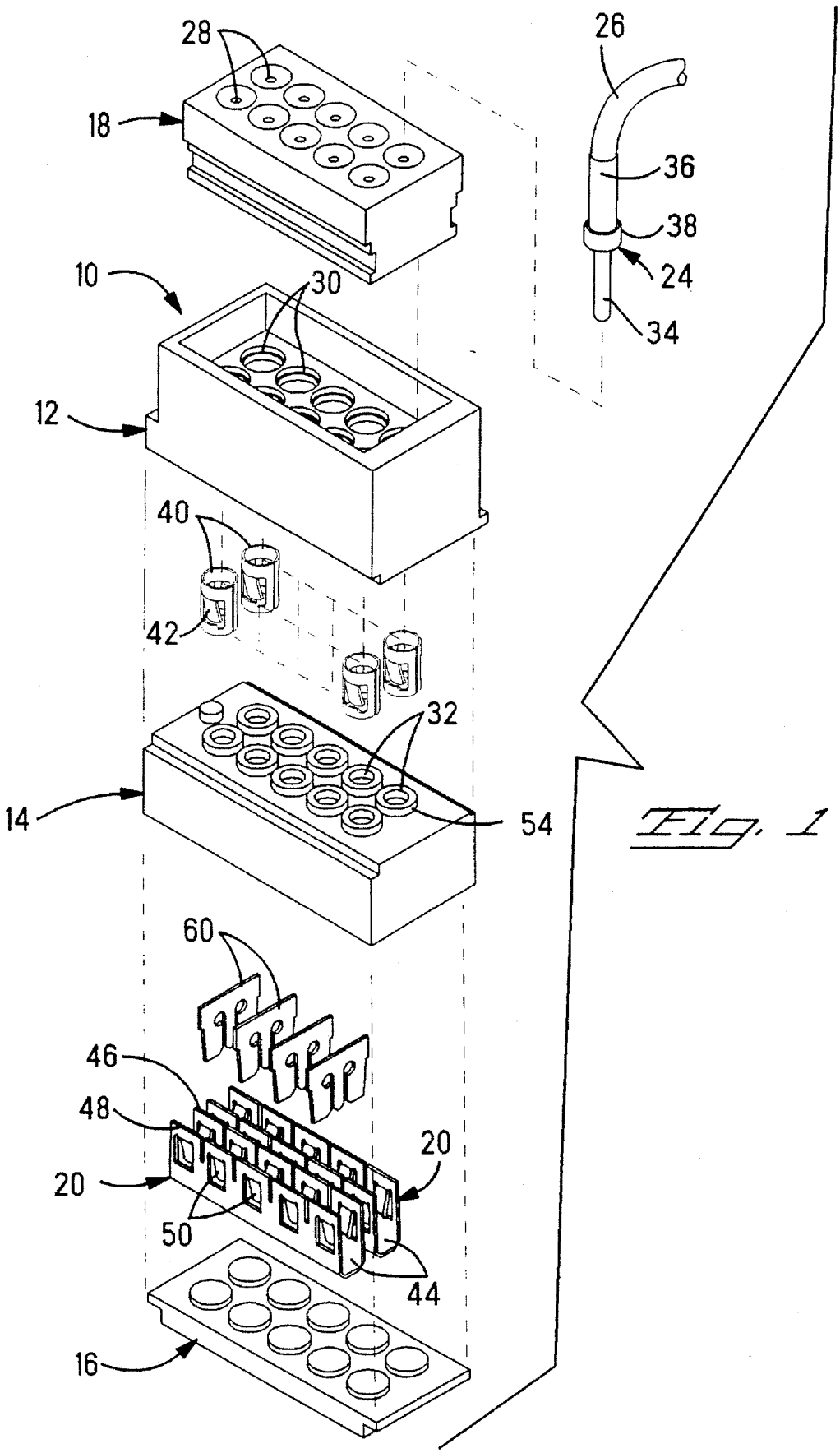
FIG. 1 is an exploded isometric view of the terminal junction block of the present invention.
Figure 2:
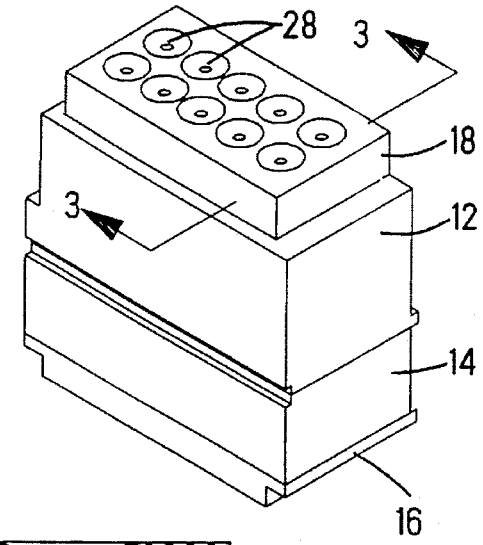
FIG. 2 is an isometric view of the assembled terminal junction block of FIG. 1.
Figure 3:
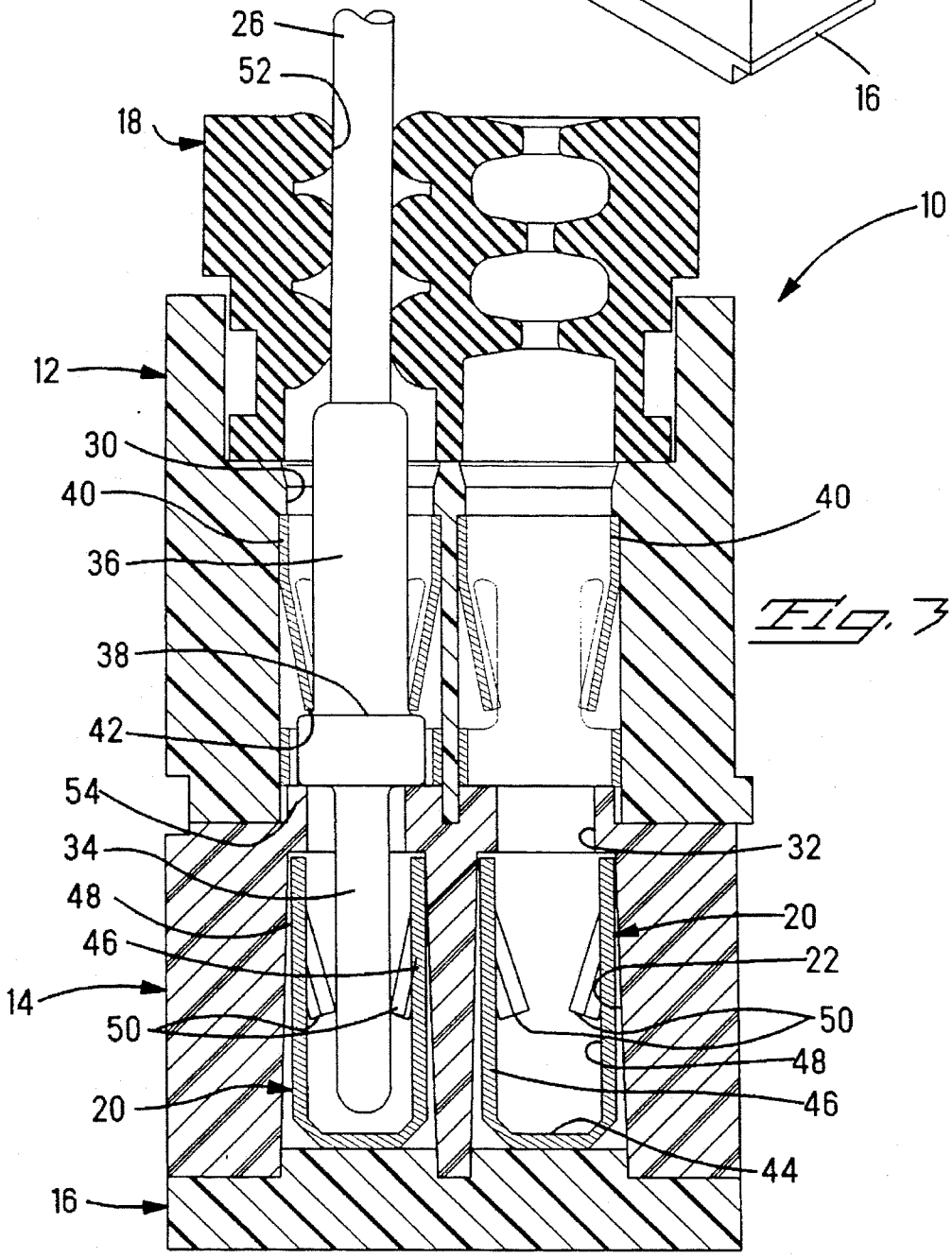
FIG. 3 is a cross-sectional view taken along lines 3—3 of FIG. 2.

Terminal junction block 10 includes an upper housing member 12, lower or main housing member 14, bottom cover 16 and sealing grommet 18, all of dielectric material with grommet 18 being of elastomeric material. Bus members 20 are disposed within channels 22 (FIG. 3) of main housing member 14 to establish electrical connection with terminals 24 terminated to conductor wires 26 upon insertion of the terminals 24 into the terminal junction block, with each elongate bus member 20 commoning all terminals 24 of a single row. Terminal-receiving apertures 28 of grommet 18 are aligned with apertures 30 of upper housing member 12 and apertures 32 of lower housing member 14. Terminal junction block 10 is shown in FIGS. 1 to 5 to be a feedback version, wherein all pin contacts are insertable into a common (upper) mating face. Commonly, not all terminal sites are utilized, and in such case an insulative plug (not shown) is inserted into the unused grommet aperture 28 to provide environmental sealing of the terminal junction block.

Terminals 24 include pin contact sections 34 extending forwardly from wire termination sections 36 and also include an annular collar 38 therearound. Retention clips 40 are disposed within respective apertures 30 in upper housing member 12, having locking lances 42 extending forwardly and inwardly to engage terminals 24 behind annular collars 38 thereof, to prevent withdrawal of the terminal from the block but are adapted to release the terminal with use of a conventional contact removal tool. Pin contact section 34 extends forwardly from retention clip 40 to be disposed within deep U-shaped channel 44 defined by inner and outer side walls 46,48 of a bus member 20, and paired pin-engaging lances 50 extend from side walls 46,48 toward each other and forwardly into channel 44 and are deflected slightly apart by pin contact section 34 upon full terminal insertion, thus establishing electrical engagement of bus member 20 with terminal 24. Embossments 52 of grommet 18 spaced axially along terminal-receiving apertures 28 thereof compress around insulated portions of conductor wire 26 to establish sealing therearound. Preferably, flanges 54 extend upwardly from lower housing member 14 about each apertures 32 and into apertures 30 of upper housing member 12, and serve as stop surfaces for insertion of terminals 24 by abutting annular collars 38 thereof.

Figure 4:
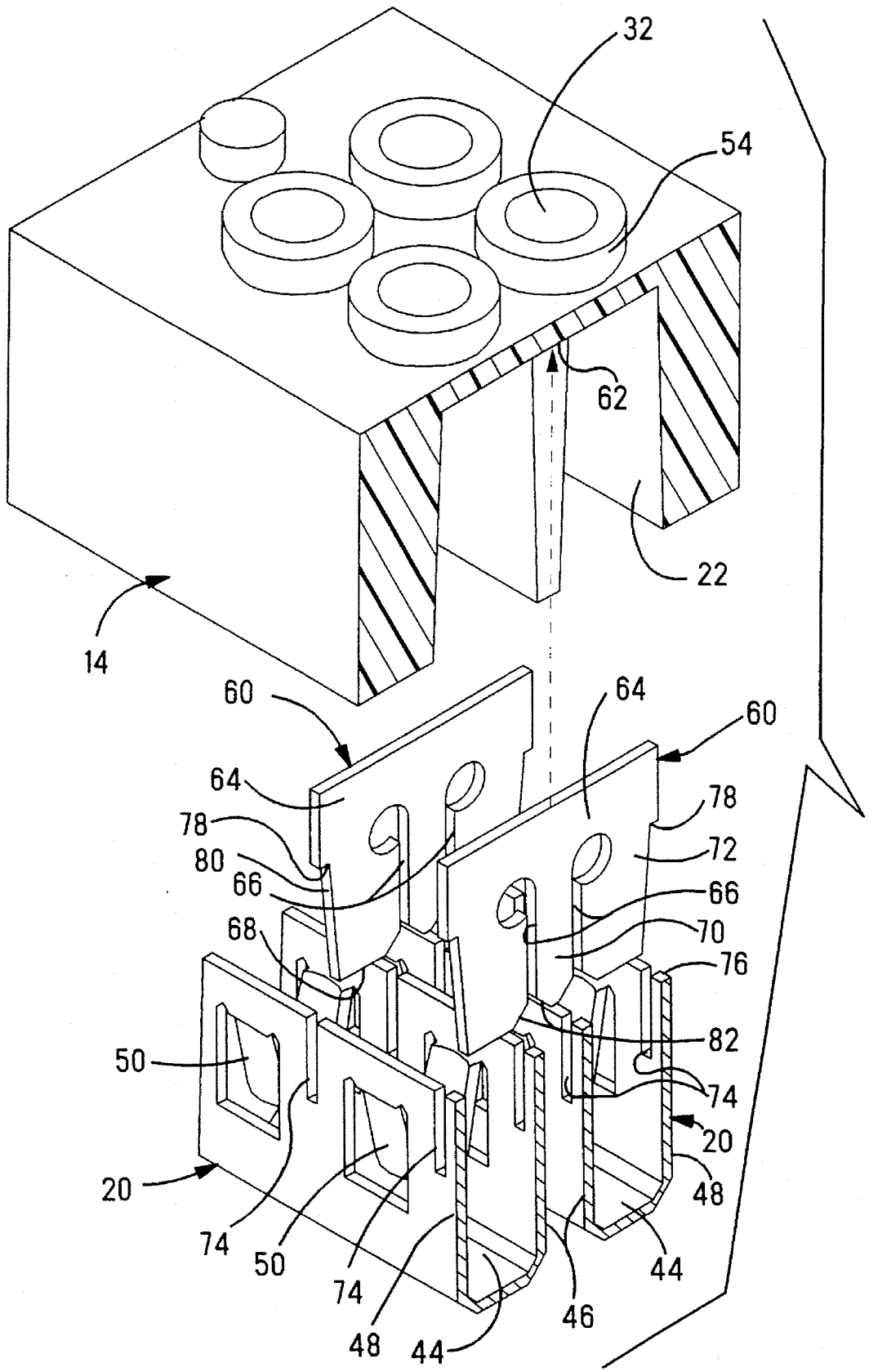
FIGS. 4 and 5 are isometric part-section views of the main housing, bus members and commoning clips of the present invention, with FIG. 4 being exploded and FIG. 5 assembled.
Figure 5:
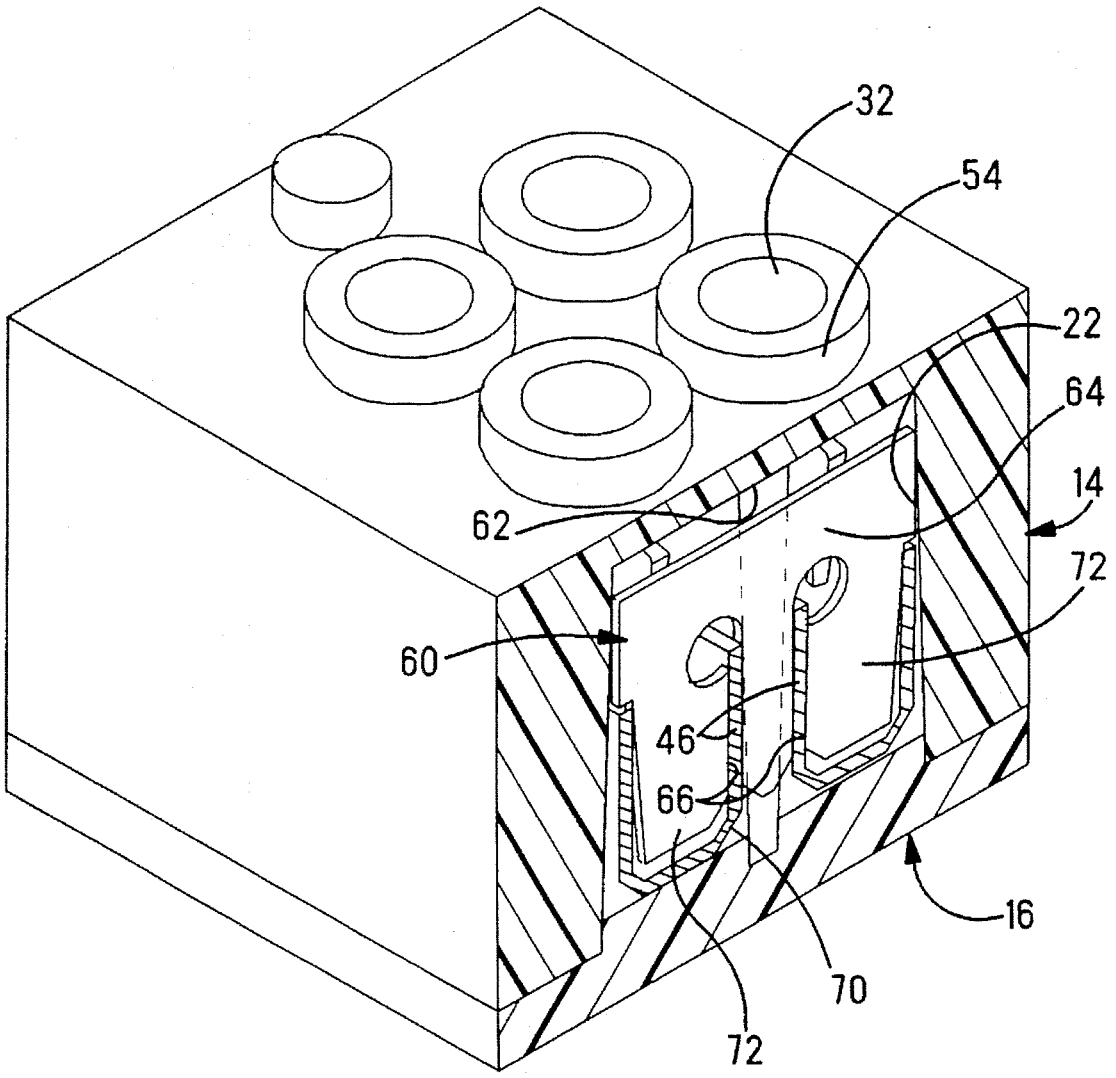

Referring to FIGS. 4 and 5, the present invention is shown wherein commoning clips 60 are insertable into slots 62 of lower housing 14 between adjacent ones of apertures 32. Body section 64 of each clip 60 is positioned at the top of a respective slot 62 near the top wall of lower housing member 14 and traverses both channels 22. Slots 66 extend from bottom edge 68 of clip 60 upward to body section 64, defining a center leg 70 between a pair of outer legs 72. Center leg 70 will be disposed between bus members 20 while each outer leg 72 will be disposed within the U-shaped channel 44 of a respective bus member 20 between side walls 46 thereof. Body section 64 will be disposed in slots 74 formed into side walls 46 from top edges 76 thereof, and ledges 78 are formed along outer legs 72 at body section 64. Outer side edges 80 of the outer legs are angled to provide a clearance with adjacent outer side wall 48 of bus member 20 to facilitate assembly. Chamfered corners 82 are formed at entrances to slots 66 of clip 60 to facilitate receipt thereinto of inner side wall 46 of each bus member 20 aligned with slots 66, and each slot 66 is preferably slightly narrower than the thickness of inner side wall 46 to assure that a friction fit is created upon full assembly thereby assuring electrical engagement between commoning clip 60 and the bus members 20.

Figure 6:
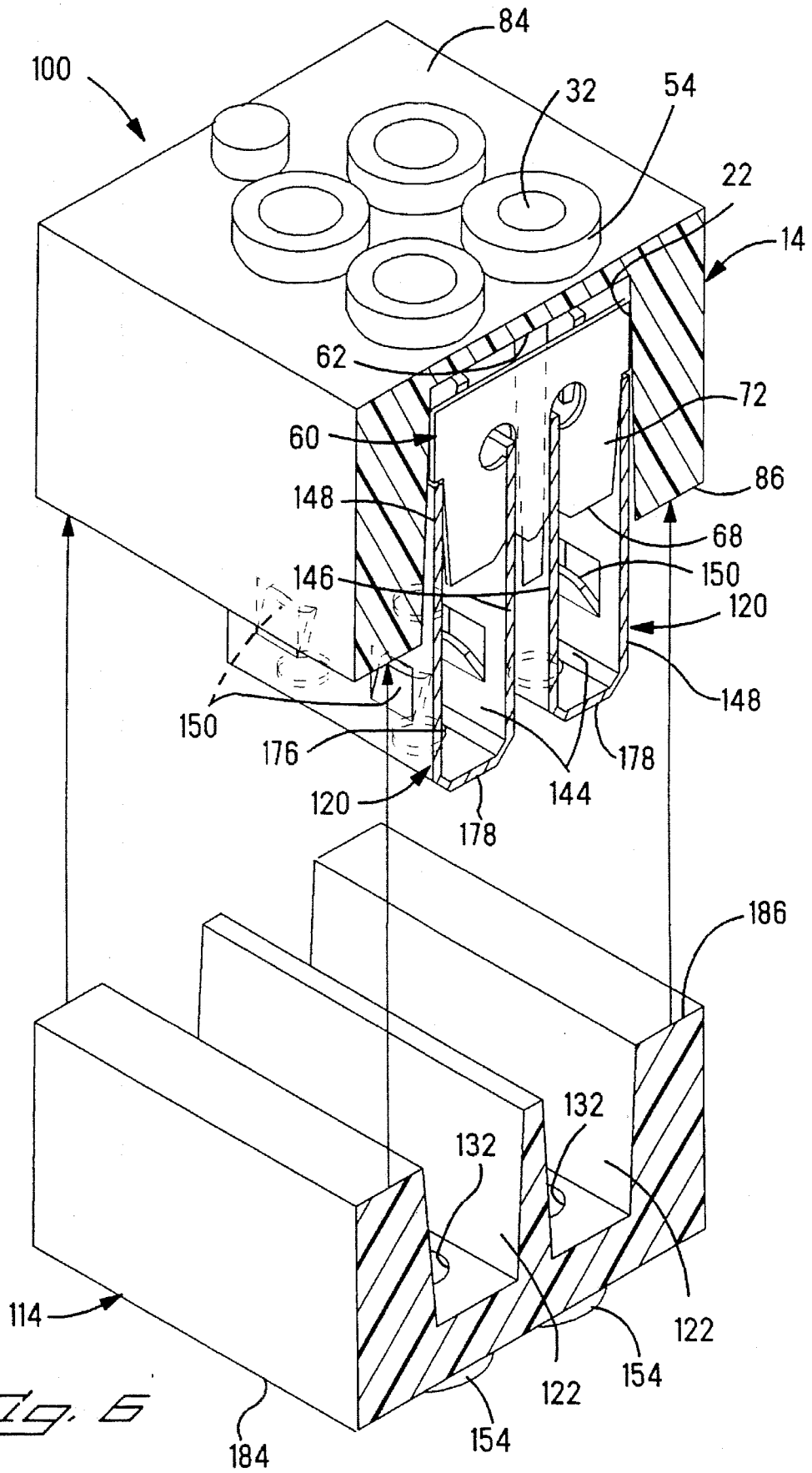
FIG. 6 is an isometric part-section partially exploded view of a feedthrough embodiment of the present invention.

In FIG. 6 is shown an alternate embodiment of terminal junction block 100, shown as a feedthrough version. A housing member 14 is shown to be identical to lower body member of FIGS. 1 to 5 and includes slots 62 in which are disposed commoning clips 60 that are in engagement with upper portions of inner walls of the bus members, as in FIG. 5. Bus members 120 have inner and outer walls 146,148 of greater height than bus members 20 of FIG. 5 to define deeper channels 144, and can be seen to extend from bottom face 86 of housing member 14. Bottom walls 178 of bus members 120 include an array of pin-receiving holes 176 aligned with a second array of pin-engaging spring arms 150. A second housing member 114 similar to housing member 14 has a face 186 for assembly to bottom face 86 of housing member 14, and includes channels 122 for receipt of the extending portions of bus members 120. An array of pin-receiving apertures 132 are aligned with pin-receiving holes 176 of the bus members, permitting another array of pin contacts terminated to other conductor wires (not shown) to be inserted through face 184 of second housing member 114 to be electrically engaged by spring arms 150 of bus members 120; also seen along face 184 are embossments 154 similar to embossments 54 along top face 84 of housing member 14. Commoning clips 60 are suitable for terminal junction block 100 as well as the feedback version, terminal junction block 10 of FIGS. 1 to 5.

The present invention requires no relocation of terminal locations in the terminal junction block of the prior art, and does not necessitate enlargement of the overall size thereof. The present invention requires only minimal revision of lower body member 14 to include clip-receiving slots thereinto, and of bus members 20 to include clip-receiving slots thereinto, and thus is cost effective. Each commoning clip may be a flat thin member stamped from sheet metal of a preferably stiff, rigid conductive metal such as beryllium copper having a thickness of about 0.012 inches, with wall-receiving slots being about 0.011 inches wide into which are inserted bus member walls of about 0.012 inches thus assuring an interference fit and assured electrical engagement. Preferably a commoning clip is used between each terminal site of the terminal junction block. It can be seen that similar commoning clips can be utilized for terminal junction blocks having more than two elongate bus members.

What is claimed is:

1. A terminal junction block of the type adapted to receive insertably into a first mating face thereof a plurality of terminals in rows and having elongate channel-shaped bus members commoning the terminals of each row, comprising:

a housing assembly including a main housing member in which the elongate bus members are disposed having inner and outer side walls defining pin receiving channels and pairs of pin-engaging contact sections to establish electrical connections with pin sections of terminals inserted into terminal sites of said housing assembly; and at least one commoning clip disposed transverse of the terminal rows in a slot between adjacent terminal sites and transverse of said elongate bus members;

each said commoning clip including a body section extending transversely of at least two said elongate bus members and including a leg depending therefrom between and adjacent inner side walls of adjacent ones of said elongate bus members to be commoned, thereby being held against deflection by said side walls, and outer legs adapted to be received into said pin receiving channels of said bus members, said outer legs being respectively spaced from said leg by wall-receiving slots with said wall-receiving slots dimensioned just less than the thickness of said inner side walls of said adjacent bus members, and said outer legs being adapted to be deflected away from said inner leg upon engagement with said inner side walls of respective said bus members so that said commoning clip assuredly engages said inner walls upon receipt of said inner walls into said wall-receiving slots, thereby commoning said elongate bus members together and commoning all said terminals electrically engaged with said commoned elongate bus members.

2. The terminal junction block as set forth in claim 1 wherein said inner and outer side walls of said bus members include clip-receiving slots extending into upper edges thereof within which said body section of a said commoning clip is disposed.

3. The terminal junction block as set forth in claim 1 wherein each said commoning clip is flat and thin.

4. The terminal junction block as set forth in claim 1 wherein entrances of said wall-receiving slots of each said commoning clip are chamfered to facilitate receipt thereinto of said inner walls of said adjacent bus members.

5. The terminal junction block as set forth in claim 1 wherein a commoning clip is positioned between each pair of adjacent terminal sites for equal distribution of power from a single input terminal site to a plurality of output terminal sites along said bus members.

6. The terminal junction block as set forth in claim 1 wherein an imperforate bottom cover is secured to the housing assembly to provide insulation of said bus members along bottoms thereof.

7. The terminal junction block as set forth in claim 1 wherein said bus members include bottom portions extending beyond a bottom face of said main housing member, and a second housing member is secured to said bottom face of said main housing member and includes channels for receipt thereinto of said extending bottom portions of said bus members, said second housing member including pin-receiving apertures thereinto aligned with pin-receiving holes and additional pin-engaging contact sections of said bus members for receipt thereinto of another plurality of terminals into a second mating face to be commoned to terminals inserted into said first mating face.

8. A terminal junction block of the type adapted to receive insertably into a first mating face thereof a plurality of terminals in rows and having elongate bus members commoning the terminals of each row, comprising:

a housing assembly including a main housing member in which the elongate bus members are disposed having inner and outer side walls defining pin receiving channels and pairs of pin-engaging contact sections to establish electrical connections with pin sections of terminals inserted into terminal sites of said housing assembly; and a plurality of commoning clips assuredly engaging and interconnecting at least two said elongate bus members, each said commoning clip disposed transverse of the terminal rows in a slot between adjacent terminal sites and transverse of said elongate bus members;

each said commoning clip including a body section extending transversely of said at least two elongate bus members, and each said clip including bus-engaging edges defined on at least one leg depending therefrom adapted to bear against side walls of said at least two elongate bus members being interconnected so that said commoning clip assuredly engages said side walls thereof upon receipt of said inner walls into said wall-receiving slots, thereby commoning together said elongate bus members and all said terminals in engagement therewith at a plurality of locations therealong for equal distribution of power from a single input terminal site to a plurality of output terminal sites along said bus members being interconnected.

9. The terminal junction block as set forth in claim 8 wherein said side walls of said bus members include clip-receiving slots extending into upper edges thereof within which said body section of a said commoning clip is disposed.

10. The terminal junction block as set forth in claim 8 wherein each said commoning clip is flat and thin.

11. The terminal junction block as set forth in claim 8 wherein entrances of said wall-receiving slots of each said commoning clip are chamfered to facilitate receipt thereinto of said side walls of said adjacent bus members.

12. The terminal junction block as set forth in claim 8 wherein an imperforate bottom cover is secured to the housing assembly to provide insulation of said bus members along bottoms thereof.

13. The terminal junction block as set forth in claim 8 wherein said bus members include bottom portions extending beyond a bottom face of said main housing member, and a second housing member is secured to said bottom face of said main housing member and includes channels for receipt thereinto of said extending bottom portions of said bus members, said second housing member including pin-receiving apertures thereinto aligned with pin-receiving holes and additional pin-engaging contact sections of said bus members for receipt thereinto of another plurality of terminals into a second mating face to be commoned to terminals inserted into said first mating face.

14. The terminal junction block as set forth in claim 8 wherein a said clip is positioned between every adjacent pair of terminal sites along said pair of bus members being interconnected.

15. A terminal junction block of the type adapted to receive insertably into a first mating face thereof a plurality of terminals in rows and having elongate bus members commoning the terminals of each row, comprising:

a housing assembly including a main housing member in which the elongate bus members are disposed having inner and outer side walls defining pin receiving channels and pairs of pin-engaging contact sections to establish electrical connections with pin sections of terminals inserted into terminal sites of said housing assembly; and at least one commoning clip disposed transverse of the terminal rows in a slot between adjacent terminal sites and transverse of said elongate bus members;

each said commoning clip including a body section extending transversely of at least two said elongate bus members and including bus-engaging edges defined on at least one leg depending therefrom adapted to bear against side walls of said at least two elongate bus members being interconnected so that said commoning clip assuredly engages said side walls thereof upon receipt of said inner walls into said wall-receiving slots, thereby commoning said at least two elongate bus members together and commoning all said terminals electrically engaged with said commoned elongate bus members; and said bus members include bottom portions extending beyond a bottom face of said main housing member, and a second housing member is secured to said bottom face of said main housing member and includes channels for receipt thereinto of said extending bottom portions of said bus members, said second housing member including pin-receiving apertures thereinto aligned with pin-receiving holes and additional pin-engaging contact sections of said bus members for receipt thereinto of another plurality of terminals into a second mating face to be commoned to terminals inserted into said first mating face.

* * * * *